US006346931B1

(12) United States Patent
Cathey et al.

(10) Patent No.: US 6,346,931 B1
(45) **Date of Patent: *Feb. 12, 2002**

(54) METHOD AND APPARATUS FOR ADJUSTMENT OF FED IMAGE

(75) Inventors: David A. Cathey; James J. Cathey, both of Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/535,964

(22) Filed: Mar. 27, 2000

Related U.S. Application Data

(63) Continuation of application No. 08/746,314, filed on Nov. 12, 1996, now Pat. No. 6,081,246.

(51) Int. Cl.[7] ..... G09G 3/22

(52) U.S. Cl. ..... 345/74.1; 315/169.3

(58) Field of Search ..... 345/74, 75, 75.1, 345/75.2, 74.1; 315/169.3, 169.1, 291

(56) References Cited

U.S. PATENT DOCUMENTS

| | | | | |
|---|---|---|---|---|
| 3,500,102 A | | 3/1970 | Crost et al. | 313/109 |
| 5,186,670 A | | 2/1993 | Doan et al. | 445/24 |
| 5,194,780 A | | 3/1993 | Meyer | 315/169.3 |
| 5,259,799 A | | 11/1993 | Doan et al. | 445/24 |
| 5,434,595 A | * | 7/1995 | Macaulay | 345/207 |
| 5,438,240 A | * | 8/1995 | Cathey et al. | 315/169.1 |
| 5,578,795 A | | 11/1996 | Smith | 315/169.3 |
| 5,578,906 A | * | 11/1996 | Smith | 315/169.3 |
| 5,760,858 A | | 6/1998 | Hodson et al. | 349/61 |
| 5,786,795 A | * | 7/1998 | Kishino et al. | 345/75 |
| 5,825,134 A | | 10/1998 | Ito | 315/169.1 |
| 5,834,900 A | | 11/1998 | Tanaka et al. | 315/169.1 |
| 5,850,120 A | | 12/1998 | Okamoto | 313/336 |
| 5,866,988 A | | 2/1999 | Oda | 315/169.1 |

OTHER PUBLICATIONS

Free, John, Electronics Newsfront, "British TV Goggles".

Latham, Roy, Mar. 1994 Real Time Graphics vol. 2, No. 8. Tutorial: Antialiasing Smoothing the Rough Edges in computer Images is No Easy Matter, pp. 6–9.

Liu, Jiang et al., 4/92 IEEE, "Field Emission Imaging Study of Silicon Field Emitters," pp. 14.3.1–14.3.4.

Palesvky, A., et al., SID 94 Digest, "6.4: Late–News Paper: Field–Emission Displays: A 10,000 –fl High–Efficiency Field–Emission Display," pp. 57–57.

Tedesco, J.M., et al., SID 93 Digest, "5.3: Holographic Diffusers for LCD Backlights and Projection Screens," pp. 29–32.

Kaiser Optical Systems, Inc., A Kaiser Aerospace & Electronics Company, "Holographic Depixelation Filter for LCD Displays".

Microsharp™ is a Revolutionary New Display Technology (Advertisement).

* cited by examiner

*Primary Examiner*—Bipin Shalwala
*Assistant Examiner*—Vanel Frenel
(74) *Attorney, Agent, or Firm*—Hale and Dorr LLP

(57) ABSTRACT

The image rendered by a field emission display is altered. The display includes emitter tips, an extraction grid, and conductive elements in a display screen. A first voltage is applied to at least one emitter tip, a second voltage is applied to the extraction grid at a location proximate the emitter tip to which the first voltage is applied, and a third voltage is applied to a portion of the display screen. The second and third voltages are separately variable so that an adjustment causing a voltage increase in one of the second and third voltages can take effect concurrently with another adjustment causing a voltage decrease in the other of the second and third voltages. The first, second, and third voltages cooperate with the structure to generate an electron emission stream impinging upon a first area of the display screen. The area of the display screen impinged by the electron emission stream is changed.

30 Claims, 7 Drawing Sheets

METHOD AND APPARATUS FOR ADJUSTMENT OF FED IMAGE

CROSS REFERENCE TO RELATED APPLICATIONS

This is a continuation of U.S. patent application Ser. No. 08/746,314, filed Nov. 12, 1996 now U.S. Pat. No. 6,801, 246.

GOVERNMENT RIGHTS

This invention was made with Government support under Contract No. DABT63-93-C-0025 awarded by the Advanced Research Projects Agency (ARPA). The Government may have certain rights in this invention.

FIELD OF THE INVENTION

The present invention relates to field emission devices ("FEDs"). More specifically, the present invention relates to a method and an apparatus with the capability to adjust on-line image definition on FED screen displays.

BACKGROUND OF THE INVENTION

Currently, in the world of computers and elsewhere, the dominate technology for constructing flat panel displays is liquid crystal display ("LCD" technology and the current benchmark is active matrix LCDs ("AMLCDs"). The drawbacks of flat panel displays constructed using AMLCD technology are the cost, power consumption, angle of view, smearing of fast moving video images, temperature range of operation, and the environmental concerns of using mercury vapor in the AMLCD's backlight.

A competing technology is cathode ray tube ("CRT") technology. In this technology area, there have been many attempts in the last 40 years to develop a practical flat CRT. In the development of flat CRTs, there has been the desire to use the advantages provided by the cathodoluminescent process for the generation of light.

The point of failure in the development of flat CRTs has centered around the complexities in the developing of a practical electron source and mechanical structure.

In recent years, FED technology has come into favor as a technology for developing low power, flat panel displays. FED technology has the advantage of using an array of cold cathode emitters and cathodoluminescent phosphors for the efficient conversion of energy from an electron beam into visible light. Part of the desire to use FED technology for the development of flat panel displays is that is very conductive for producing flat screen displays that will have high performance, low power, and light weight. Some of the specific recent advances associated with FED technology that have made it a viable alternative for flat panel displays are large area 1 $\mu$m lithography, large area thin-film processing capability, high tip density for the electron emitting micropoints, a lateral resistive layer, anode switching, new types of emitter structures and materials, and low voltage phosphors.

Referring to FIG. 1, a representative cross-section of a prior art FED is shown generally at 100. As is well known, FED technology operates on the principal of cathodoluminescent phosphors being exited by cold cathode field emission electrons. The general structure of a FED includes silicon substrate or baseplate 102 onto which thin conductive structure is disposed. Silicon baseplate 102 may be a single crystal silicon layer.

The thin conductive structure may be formed from doped polycrystalline silicon that is deposited on baseplate 102 in a conventional manner. This thin conductive structure serves as the emitter electrode. The thin conductive structure is usually deposited on baseplate 102 in strips that are electrically connected. In FIG. 1, a cross-section of strips 104, 106, and 108 is shown. The number of strips for a particular device will depend on the size and desired operation of the FED.

At predetermined sites on the respective emitter electrode strips, spaced apart patterns of micropoints are formed. In FIG. 1, micropoint 110 is shown on strip 104,micropoints 112, 114, 116, and 118 are shown on strip 106, and micropoint 120 is shown on strip 108. With regard to the patterns of micropoints, on strip 106,a square pattern of 16 micropoints, which includes micropoints 112, 114, 116, and 118, may be positioned at that location. However, it is understood that one or a pattern of more than one micropoint may be located at any one site.

Preferably, each micropoint resembles an inverted cone. The forming and sharpening of each micropoint is carried out in a conventional manner. The micropoints may be constructed of a number of materials. Moreover, to ensure the optimal performance of the micropoints, the tips of the micropoints can be coated or treated with a low work function material.

Alternatively, the structure substrate, emitter electrode, and micropoints may be formed in the following manner. The single crystal silicon substrate may be made from a P-type or an N-type material. The substrate may then treated by conventional methods to form a series of elongated, parallel extending strips in the substrate. The strips are actually wells of a conductivity type opposite that of the substrate. As such, if the substrate is P-type, the wells will be N-type and vice-versa. The wells are electrically connected and form the emitter electrode for the FED. Each conductivity well will have a predetermined width and depth (which it is driven into the substrate). The number and spacing of the strips are determined to meet the desired size of field mission cathode sites to be formed on the substrate. The wells will be the sites over which the micropoints will be formed. No matter which of the two methods of forming the strips is used, the resulting parallel conductive strips serve as the emitter electrode and form the columns of the matrix structure.

After either of two methods of forming the emitter electrode are used, dielectric insulating layer 122 is deposited over emitter electrode strips 104, 106, and 108, and the pattern micropoints located at predetermined sites on the strips. The insulating layer may be made from silicon dioxide ($SiO_2$).

A conductive layer is disposed over insulation layer 122. This conductive layer forms extraction structure 132. The extraction structure 132 is a low potential anode that is used to extract electrons from the micropoints. Extraction structure 132 may be made from chromium, molybdenum, or doped polysilicon or silicided polysilicon. Extraction structure 132 may be formed as a continuous layer or as a parallel strips. If parallel strips form extraction structure 132, it is referred to as an extraction grid, and the strips are disposed perpendicular to emitter electrode strips 104, 106, and 108. The strips when used to form extraction structure 132, they are the rows of the matrix structure. Whether a continuous layer or strips are used, once either is positioned on the insulating layer, they are appropriately etched by conventional methods to surround but be spaced away from the micropoints.

At each intersection of the extraction and emitter electrode strips or at desired locations along emitter electrode steps when a continuous extraction structure is used, a micropoint or pattern of micropoints are disposed on the emitter strip. Each micropoint or pattern of micropoints are meant to illuminate one pixel of the screen display.

Once the lower portion of the FED is formed according to either of the methods described above, faceplate 140 is fixed a predetermined distance above the top surface of the extraction structure 132. Typically, this distance is several hundred $\mu$m. This distance is maintained by spacers that are formed by conventional methods and have the following characteristics: (1) non-conductive to prevent an electrical breakdown between the anode (at faceplate 140) and cathode (at emitter electrodes 104, 106, and 108), (2) mechanically strong and slow to deform, (3) stable under electron bombardment, (4) order of 400° C., and (5) small enough not to interfere with the operation of the FED. Representation spacers 136 and 138 are shown in FIG. 1.

Faceplate 140 is a cathodoluminescent screen that is constructed from clear glass or other suitable material. A conductive material, such as indium tin oxide ("ITO" is disposed on the surface of the glass facing the extraction structure. ITO layer 142 serves as the anode of the FED. A high vacuum is maintained in area 134 between faceplate 140 and baseplate 102.

Black matrix 149 is disposed on the surface of the ITO layer 142 facing extraction structure 132. Black matrix 149 defines the discreet pixel areas for the screen display of the FED. Phosphor material is disposed on ITO layer 142 in the appropriate areas defined by black matrix 149. Representative phosphor material areas that define pixels are shown at 144, 146, and 148. Pixels 144, 146, and 148 are aligned with the openings in extraction structure 132 so that a micropoint or group of micropoints that are meant to excite phosphor material are aligned with that pixel. Zinc oxide is a suitable material for the phosphor material since it can be excited by low energy electrons.

A FED has one or more voltage sources that maintain emitter electrode strips 104, 106, and 108, extraction structure 132, and ITO layer 142 at three different potentials for proper operation of the FED. Emitter electrode strips 104, 106, and 108 are at "−" potential, extraction structure 132 is at a "+" potential, and the ITO layer 142 at a "++". When such an electrical relationship is used, extraction structure 132 will pull an electron emission stream from micropoints 110, 112, 114, 116, 118, and 120, and, thereafter, ITO layer 142 will attract the freed electrons.

The electron emission streams that emanate from the tips of the micropoints fan out conically from their respective tips. Some of the electrons strike the phosphors at 90° to the faceplate while others strike it at various acute angles. The contrast and brightness of the screen display of the FED are optimized when the emitted electrons strike or impinge upon the phosphors at 90°.

Typically, color FEDs use a switched anode scheme in providing color images. In such a scheme, the pixel colors red, green, and blue are arranged in columns. All of the red columns are tied together, all of the blue are tied together, and all of the green columns are tied together. For each frame, the red, green, and blue images are sequentially displayed. There are, however, other methods of providing color in FEDs, which are known.

In computer graphical images, an issue that must be addressed is the aliasing problem. This problem is manifest at the edges of a computer image which make them look stairstepped rather than straight, polygons crawl across a screen in steps rather than advance smoothly, and thin lines break up into dotted lines.

The aliasing problem is created because of the need to approximate what each whole pixel will be as a color. As such, it can result in reducing an image that has great detail, such as a photographic picture, to one of lesser detail. Specifically, the result is usually a digitized version of the photographic picture.

In many cases, the aliasing problem can be corrected but usually at great cost. This cost is for the extra processing that is needed for the purpose of preventing aliasing. This processing is referred to as antialiasing.

Antialiasing is not a process that is used to correct a picture with aliasing, but a process that is used in the original processing of the image data before the pixels of the image are determined. When antialiasing is properly performed, there is a greater degree of sharpness in the computer graphical image that is created.

Referring to FIGS. 2 and 3, the aliasing problem will be described in greater detail. A pixel may theoretically be capable of having many different colors simultaneously, however, in reality, when a image on a screen display is presented, a single color is computerized for any one pixel at a given point in time rather than a single pixel having a complex combination of colors. A typical way to do this, which demonstration of the aliasing problem, is that the color for a particular pixel is determined by the color that is at the center point of the pixel.

Referring to FIG. 2, a 5×4 block of pixels is shown generally at 200. The centers of each of the pixels is indicated. Polygon 202 crosses this block of pixels as shown. There can be a substantial error in the representation polygon if the center of pixel method is used to determine the color of the respective pixels when attempting to replicate the actual polygon shape on the screen display.

Referring to FIG. 3, generally at 250, the shape of the polygon 202 results in polygon 252 when the center method is used. As is shown, the sharp line of polygon 202 becomes stairstepped in polygon 252. If two colors are being considered, for example, black and white, when polygon 202 crosses a pixel such that it does not cover the center, the complete pixel, will be white; on the other hand, if the polygon does cover the center of the pixel, the entire pixel will be the second color, which in this case will mean the pixel will black. Therefore, a straight line of a polygon, upon inspection, will appear stairstepped. If this polygon is moving across the screen, as the edge of the polygon crosses the center points of the various pixels, there will be line break ups and crawling in steps.

A first solution to the aliasing problem is to make smaller pixels which will increase resolution. However, this is expensive and does not eliminated the problem only makes it less perceptible. Another possible solution is using an oversampling technique in which the polygon is sampled at several points in the pixel rather than just at the center. This will effect a result similar to that of using higher resolution without actually making the pixels smaller.

Referring to FIGS. 4 and 5, the oversampling method will be described. In FIG. 4, a 3×2 block of pixels is shown generally at 300. This block includes pixels 302, 304, 306, 308, 310, and 312. Each of these pixels has been divided into four subpixels and the centers of the subpixels are indicated. This has the effect of increasing the resolution for purpose of defining images, but at a fraction of the cost as it would be to actually create such a higher resolution FED.

In FIG. 4, polygon 314 crosses pixels 302, 304, 306, 308, 310, and 312 as shown. In FIG. 5, generally at 350, the screen display representation of polygon 314 is shown as polygon 352. Although there is stairstepping, its effect is less because of the apparent higher resolution so the line of polygon 352 will appear closer to the line of polygon 314, thus providing a sharper image.

In FED images, like other computer graphical images, pixels can typically have a random access variability of intensity from a minimum value near zero (0) footlamberts to a maximum of 10–1000 footlamberts. A footlambert is equal to 3.42626 cadela/meter$^2$ (cd/m$^2$). In spatial color displays, the pixels have different CIE (Comite International de Eclairage) primary color coordinates for light emission. The most common is that ⅓ are red pixels, ⅓ are green pixels, and ⅓ are blue pixels. Normally, the different colored pixels are separated by a black region such that a black grid or grill is formed around the pixels.

Aliasing along with the existence of the black grid will result in very sharp definitions at the edges of images. Moreover, when the border regions between pixels are aggressively separated by using a black grid or grill, a crisp digitized appearance is visually apparent to someone viewing a screen image. This, also can lead to the image appearing grainy because of the existence of the block grid and, in the worst case, the image can have a chicken-wire effect. This latter problem is not corrected solely by employing antialiasing techniques.

When the border regions are not aggressively separated, such as by use of a black grid, the effect is that there can be undesirable blending of the colors of two adjoining pixels. This appears to the viewer as an overlap of the edges of two polygons. As such, the blending may appear as a blurring of the lines between two polygons. This also is not solved solely by employing antialiasing techniques.

In order to attempt to correct the pixel separation problems in FEDs that are not solved by employing antialiasing techniques, there are several procedures that have been used to set the pixel element definition of the screen display. An approach is to adjust the distance between the light emitting pixel elements of the screen display during the time the screen display is fabricated. Examples of the use of this technique are: (1) the distance is adjusted between the phosphor elements of respective pixels on the faceplate of the FED by means of the black matrix or grid, (2) the distance is adjusted between the color filters again by means of the black matrix or grid, (3) the distance is adjusted between the faceplate and baseplate of the FED, and (4) the use of microlens optics between the viewer and the screen display to optically diffuse the pixel edges toward each other.

Although, the four (4) methods have been proposed, they all suffer from the problem that in each of these cases, there is a lack of an ability to make further adjustments in order to achieve the desire affect in the images on the screen display once an initial adjustment is made early in the fabrication stage or made permanently in the fabrication of the apparatus. This problem could be solved by adding an additional electron beam focusing element to the FED structure so that there can be deflection of the electron beams. This method is not particularly desirable because it requires considerable baseplate processing challenges and is expensive.

Therefore, it is very desirable to have a solution that is simple and inexpensive that can be applied to FED system to solve the problems associated with image definition that are not solved with antialiasing techniques.

SUMMARY OF THE INVENTION

The present invention is a low cost system and method for making adjustments to the pixel boundaries of images in a screen display of an FED to overcome the problems created by pixel separation which are not solved by antialiasing techniques. Moreover, the present invention provides a system and method that can actively adjust the pixel edge definition of images on a screen display to obtain the viewer's desired screen display effect.

According to the present invention, in order to provide the desired adjustment to the pixel boundaries of the images on the screen display, it is necessary to accurately control the voltages on the extraction structure and anode. The voltage to the extraction structure, which is positive with respect to the electron emitter and micropoints, induces an high electrical field with regard to a associated micropoint. This induces Fowler-Nordheim tunneling and electron emission according to the expression:

$$J = C_1 \cdot E^2 \cdot e^{C_2/E}$$

where, $J$ = The emitted current density (amps/m$^2$).

$C_1$, $C_2$ = The constants which depend of material's work function, surface potential, and Fermi level.

$E$ = The electric field (volts/m).

The voltage that is applied to the extraction structure frees the electron emission streams that are attracted by the anode to the phosphor elements of a pixel. An electron emission stream has a horizontal (or lateral) component and a vertical component (toward the faceplate). The lateral component is nearly completely controlled by the voltage on the extraction structure because the space charge effect in FEDs is relatively small compared to the high field strengths caused by the extraction structure voltage that cause the electron emission stream to be emitted from a micropoint. As such, the larger the extraction structure voltage, the larger the lateral trajectory of the electron emission stream. To the contrary, the smaller the extraction structure voltage, the smaller the lateral trajectory of the electron emission stream.

The vertical component to the emission is affected substantively by the voltage that is applied to the ITO layer (anode) at the faceplate of the FED. Typically, at a minimum, this anode voltage is four (4) times larger that the extraction structure voltage. Preferably, the anode voltage is much higher than this with respect to the extraction structure voltage.

The anode voltage imparts a vertical acceleration on the electron emission. This attracts the electron emission stream to the phosphor material of a pixel at the bottom surface of the faceplate to produce the cathodoluminescent photons, which the viewer sees. The higher the anode voltage, the greater the acceleration of the electrons of the electron emission stream toward the anode. This also will mean that the time that the electron emission stream is influenced by lateral forces imparted by the extraction structure voltage will be short and be of less affect. The contrary is true when the anode voltage is lower. As such, the anode voltage has an influence on the spot size for a particular electron emission stream at a phosphor material of a pixel on the faceplate.

The final spot size of an electron emission stream on a phosphor element on the faceplate is a function of the time of travel of the electrons of the electron emission, which is controlled by the anode voltage, and the lateral component, which is controlled by the extraction structure voltage. In a system in which the distance between the emitter electrode and anode (at the faceplate) is fixed, a fixed gap system, the final spot size depends on the ratio of the anode voltage to the extraction structure voltage. If the ratio is increased, the final spot will be smaller, and if the ratio is decreased, the final spot will become larger. The on-line active adjustment of the spot size at the phosphor material at the faceplate will increase and decrease the distance between pixels to effect adjustment of the pixel boundaries. Therefore, the images on the screen display can have their definition actively adjusted as desired by the viewer.

An object of the present invention is to provide a FED system that permits the viewer to actively adjust the image definition on-line.

Another object of the present invention is to provide a FED system in which the desired effect at the borders of images on the screen display is attainable.

A yet further object of the present invention is to provide a FED system in which the ratio of the anode voltage and the extraction structure voltage may be actively adjusted to obtain a desired screen display effect.

These and other objects of the present invention will be discussed in detail in the remainder of the specification referring to the drawings. dr

DETAILED DESCRIPTION OF THE DRAWINGS

The present invention is a low cost system and method for making adjustments on-line to the pixel boundaries of images in a screen display of a FED. The system and method of the preferred invention actively adjust the edge definition of images on a screen display to achieve the desired screen display effect.

Figure 7:
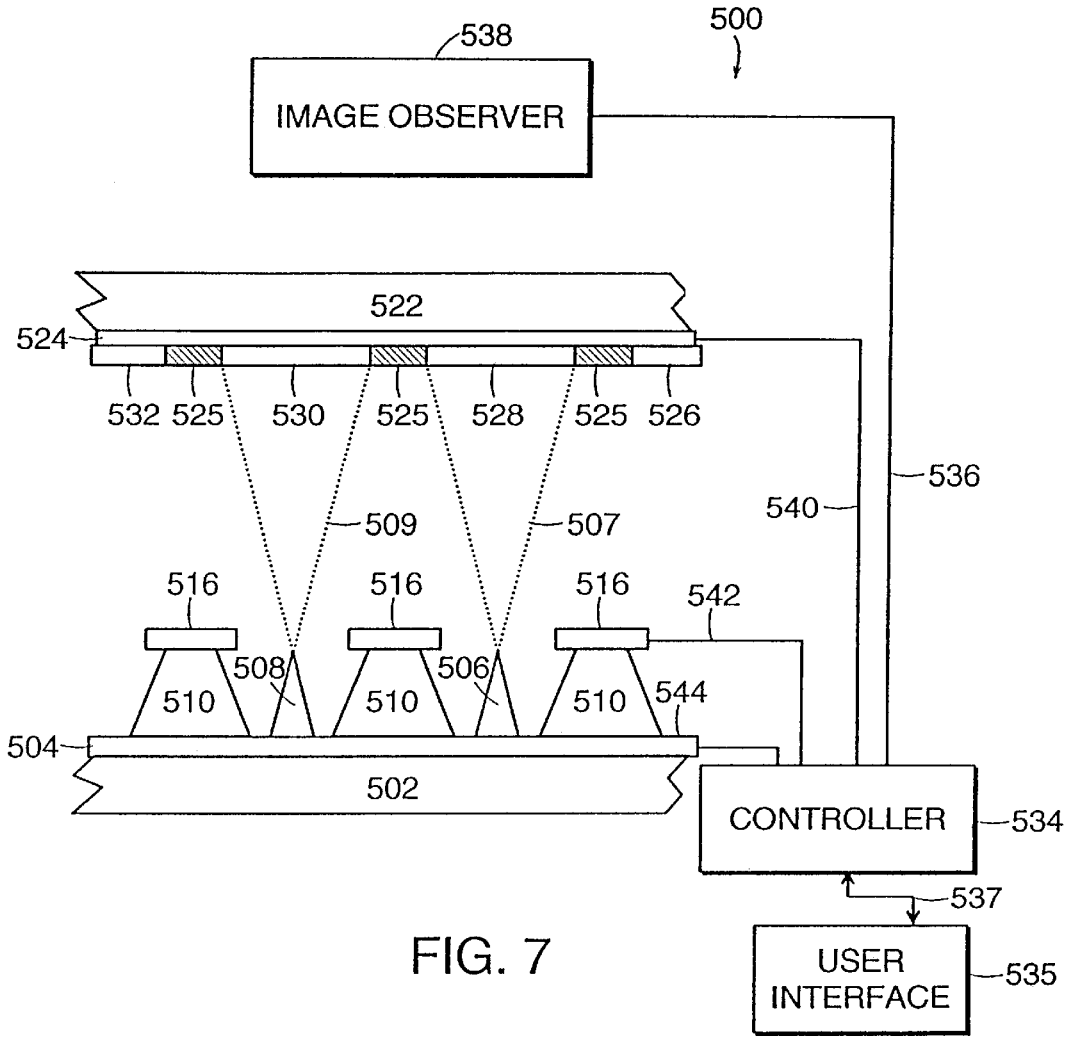
FIG. 7 shows the preferred embodiment of the FED of the present invention.

Referring to FIG. 7, a partial cross-section of the preferred embodiment of the FED of the present invention is shown generally at 500. According to this embodiment, emitter electrode 504 is formed in wells in substrate 502 by any of a number of conventional semiconductor processing methods, such as diffusion or ion field implantation techniques. Generally, the emitter electrode will consist of a number of spaced apart, parallel wells that are electrically connected. Emitter electrode 504 is one of the parallel disposed wells. The number and spacing of the parallel spaced apart wells is determined by the needs of the FED.

Preferably, substrate 502 is formed from a P-type single crystal silicon structure and the emitter electrode 504 is N-type single crystal silicon structure, which is the opposite conductivity type. It is understood, however, the conductivity types for substrate 502 and emitter electrode 504 can be reversed and still be within the scope of the present invention. Emitter electrode 504 is the cathode conductor of the FED of the present invention.

At predetermined locations on emitter electrode 504 above which pixels will be situated, one of more micropoints are formed on emitter electrode 504. These micropoints are formed on emitter electrode 504 and sharpened by conventional semiconductor processing methods. In FIG. 7, two spaced apart micropoints are shown, micropoint 506 and micropoint 508. Preferably, the micropoints are integrally formed from the same material as emitter electrode 504 and have their tips coated with a low work function material. Suitable low work function materials are cermet ($Cr_3Si$+ $SiO_2$), cesium, rubidium, tantalum nitride, barium, chromium silicide, titanium carbide, molybdenum, and niobium. These are deposited on the micropoints using conventional semiconductor processing methods, such as vapor deposition. It is understood that other suitable materials also may be used.

Each micropoint is surrounded with insulating layer 510. As is shown in FIG. 7, insulating layer 510 is spaced away from micropoints 506 and 508. Insulating layer 510 electrically insulates the positive electrical elements of the FED of the present invention from the negative emitter electrode. Preferably, insulating layer 504 is formed from silicon dioxide ($SiO_2$).

Conductive layer 516 is disposed on insulating layer 510. Conductive layer is positioned on insulating layer 510 by conventional semiconductor processing methods. Preferably, conductive layer 516 is formed from doped polysilicon or silicided polysilicon.

Conductive layer 516 surrounds micropoints 506 and 508 for the purpose of causing an electron emission stream to be emitted from these micropoints and others of the FED. Conductive layer 516 also may be a series of electrically connected parallel strips disposed on insulating layer 510. In either configuration, conductive layer 516 serves as an extraction structure and, hereafter, will be referred to as such.

Spaced above extraction structure 516 is faceplate 522. Faceplate 522 is a cathodoluminescent screen that preferably is made from a clear, transparent glass. However, it is understood that other transparent materials may be used, and still be within the scope of the present invention. Faceplate 522 must be capable of transmitting the light of cathodoluminescent photons, which the viewer sees.

ITO layer 524 is disposed on the bottom surface of faceplate 522 which faces extraction structure 516. ITO layer 524 is a layer of electrically conductive material that may be disposed as a separate layer on faceplate 522 or made as part of the faceplate. ITO layer 524, in any case, is transparent to the light from cathodoluminescent photons and serves as the anode for the FED.

In FIG. 7, pixels 526 (in-part), 528, 530, and 532 (in-part) are shown disposed on the surface of ITO layer 524 facing extraction structure 516. As is shown, pixel 528 is disposed over micropoint 506 and pixel 530 over micropoint 508. The micropoints for pixels 526 and 532 are not shown. In FIG. 7, there is only one micropoint associated with one pixel; however, it is understood that more than one micropoint may be associated with a pixel, such a 4×4 or 5×5 square pattern of micropoints or a generally random array of micropoints.

The pixel areas have a phosphor material deposited on the bottom of ITO layer 524 in a desired pattern. Generally, the pixels are square in shape. The phosphor materials that is used is preferably one that can be excited by low energy electrons. Zinc oxide is a preferred phosphor materials but other suitable phosphor materials may be used and still be within the scope of the present invention.

The pixels are divided by black matrix 525. Black matrix 525 may be of any suitable material. Preferably, it is made from a plastic material. It is understood that other materials that are opaque to the transmission of light and not affected by electron bombardment also may be used.

As is shown in FIG. 7, faceplate 522 is spaced away from substrate 502. This is a predetermined distance usually in the 100–200 $\mu$m range. This spacing is maintained by spacers which are not shown. The area between faceplate 522 and substrate 502, preferably, is under high pressure.

Figure 8:
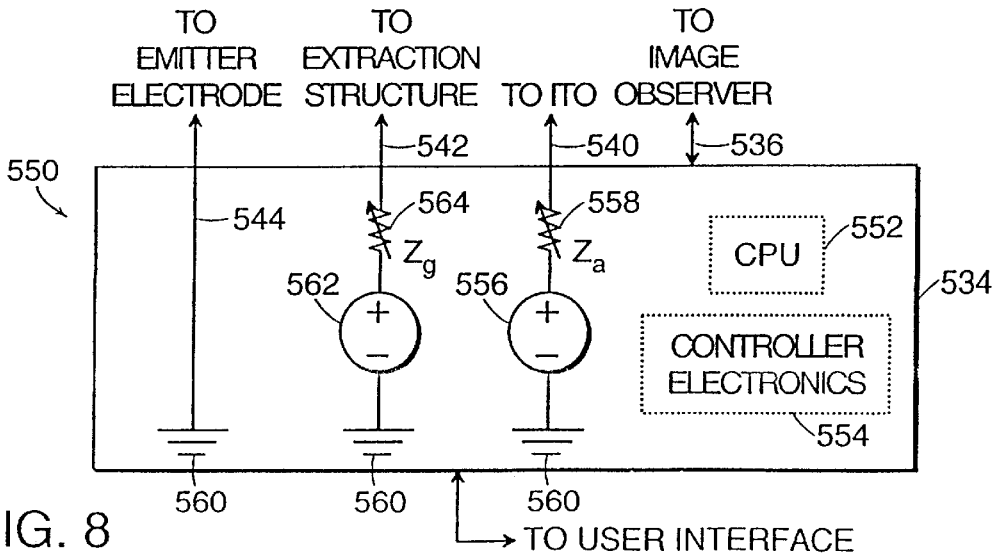
FIG. 8 shows the controller of the FED shown in FIG. 7 in greater detail.

Referring to FIGS. 7 and 8, controller 534 connects to image observer 538 via line 536, ITO layer 524 via line 540, extraction structure 516 via line 542, emitter electrode 504 via line 544, and user interface 535 via line 537. Controller 534 is shown in detail in FIG. 8 at 550. Controller provides the voltage potentials to the emitter electrode 504, extraction structure 516, and ITO layer 524 to obtain the desired screen display effect. Controller 534 also receives signals from image observer 538, and send and receives signals to user interface 535.

Image observer 538 provides feedback signals to controller 534 with respect to current visual representation of images on the screen display. For example, image observer will detect whether the edges of the images on the screen display are sharply defined and screen display suffers from the chicken-wire effect or, on the opposite extreme, the color of the images are very highly blended along the edges between images and there is no chicken-wire effect seen.

Now to discuss controller 534 in detail, referring to FIGS. 7 and 8, line 544 of controller 534 connects to ground 560. Line 544 also connects to emitter electrode 504. As such, emitter electrode 504 is maintained at ground voltage.

Line 542 of controller 534 connects to extraction structure 516. Line 542 also connects to voltage source 562 via variable resistor 564 that is shown as $Z_g$ in FIG. 8. Voltage source 562 applies a positive voltage to extraction structure 516 that is sufficient to cause an electron emission stream to be emitted from the micropoints, such as micropoints 506 and 508. Representative emissions from micropoints 506 and 508 are shown at 507 and 509, respectively. Although adjustment of variable resistor 564 will change the voltage that is applied to extraction structure 516, the voltage that is applied to the extraction structure is always sufficient to cause the emission of an electron stream from the micropoints. The voltage that is applied to extraction structure controls the lateral trajectory of the electron emission streams.

Line 540 of controller 534 connects to ITO layer 524. Line 542 also connects to voltage source 556 via variable resistor 558, which is shown as $Z_a$ in FIG. Voltage source 556 applies a positive voltage to ITO layer 524 and this voltage is larger than the voltage that is applied to extraction structure 516. Variable resistor 558, $Z_a$, adjusts the voltage that is applied to ITO layer 524, the anode, but the voltage always is sufficient to cause an electron emission stream to be attracted to the anode. The voltage that is applied to the anode controls the vertical component of the trajectory of the electron emission streams.

Operation of controller 534 is controlled by CPU 552 and controller electronics 554. CPU 552 and controller electronics 554 receiver inputs from image observer 538 regarding the current condition of the screen display. CPU 552 and controller electronics 554 control the voltages that are applied to extraction structure 516 and ITO layer 524 by adjusting variable resistors 558 and 564 to control the lateral and vertical components of the electron emission streams. The control of lateral and vertical components control the diameter of the spot that impinges on the phosphor material. The method of control, according to the present invention, will be discussed in greater detail referring to FIGS. 9 and 10.

User interface 535 is used by the viewer to send command signals to controller 534 to produce the screen display effect that the viewer desires. This interface may be equipped with an appropriate display that will display visual or textual information regarding the display screen conditions. This will permit the viewer to assess the display screen condition in light of the command signals that he or she provides to the controller.

It is understood that the FED system of the present invention may have a controller which has the necessary controls that the user can access for controlling the ratio of the anode voltage to the extraction voltage, thus obviating the need for user interface 535.

The FED has been described as including image observer 538; however, it is within the scope of the present invention that the device does not have to include an image observer but the viewer will visually inspect the screen display and determine when the desired visual effect has been achieved. This can be done using the naked eye or by using some type magnification device. In either case, the viewer will view the screen display as the adjustment commands take affect and when the desired effect is achieved the viewer will cease adjusting the screen display.

Figure 9:
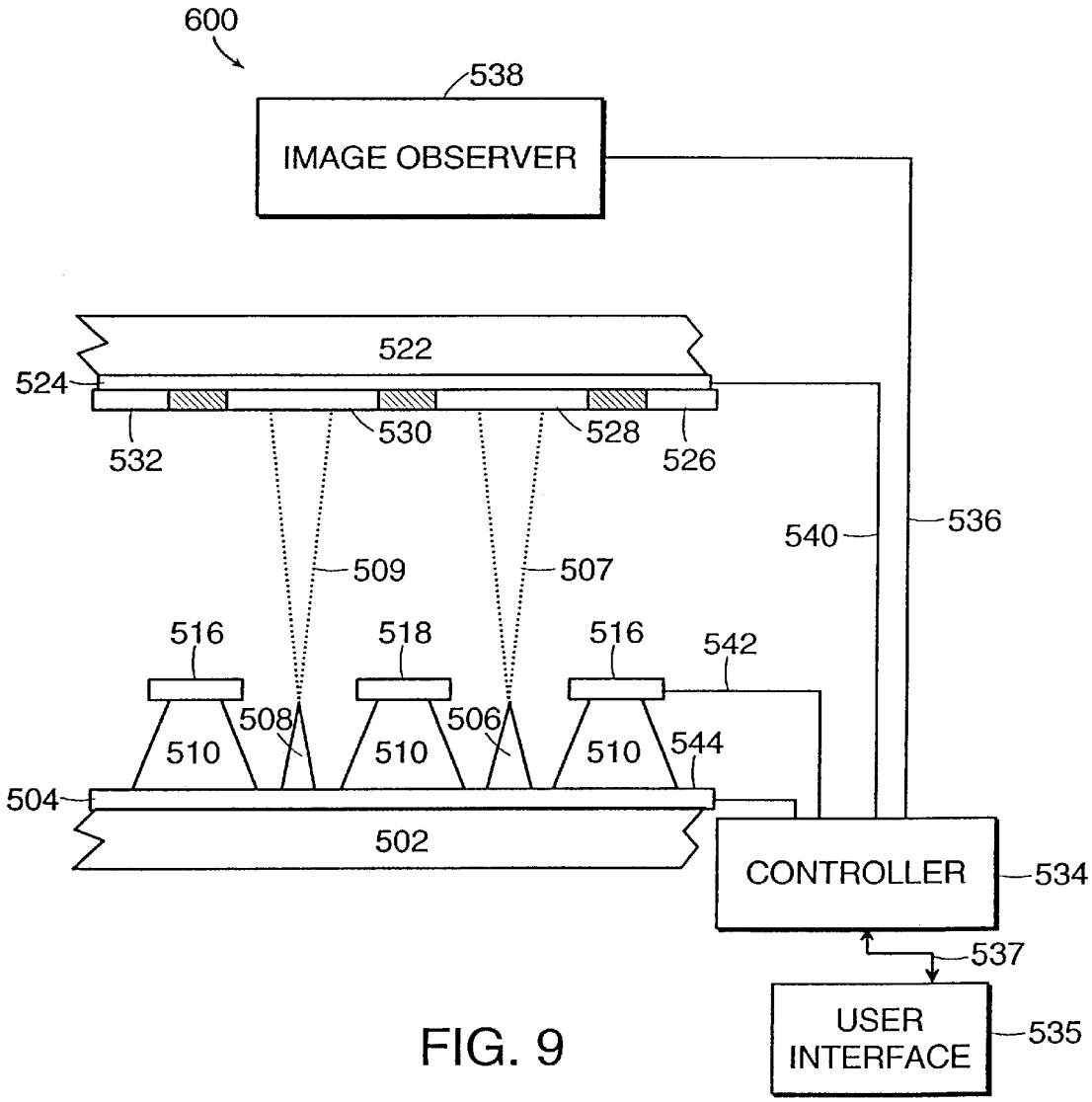
FIG. 9 shows the preferred embodiment of the FED of the present invention in which the ratio of the anode voltage to extraction structure voltage is large, which adjusts the spot of the electron emission to be smaller for very sharp pixel edge definition.
Figure 10:
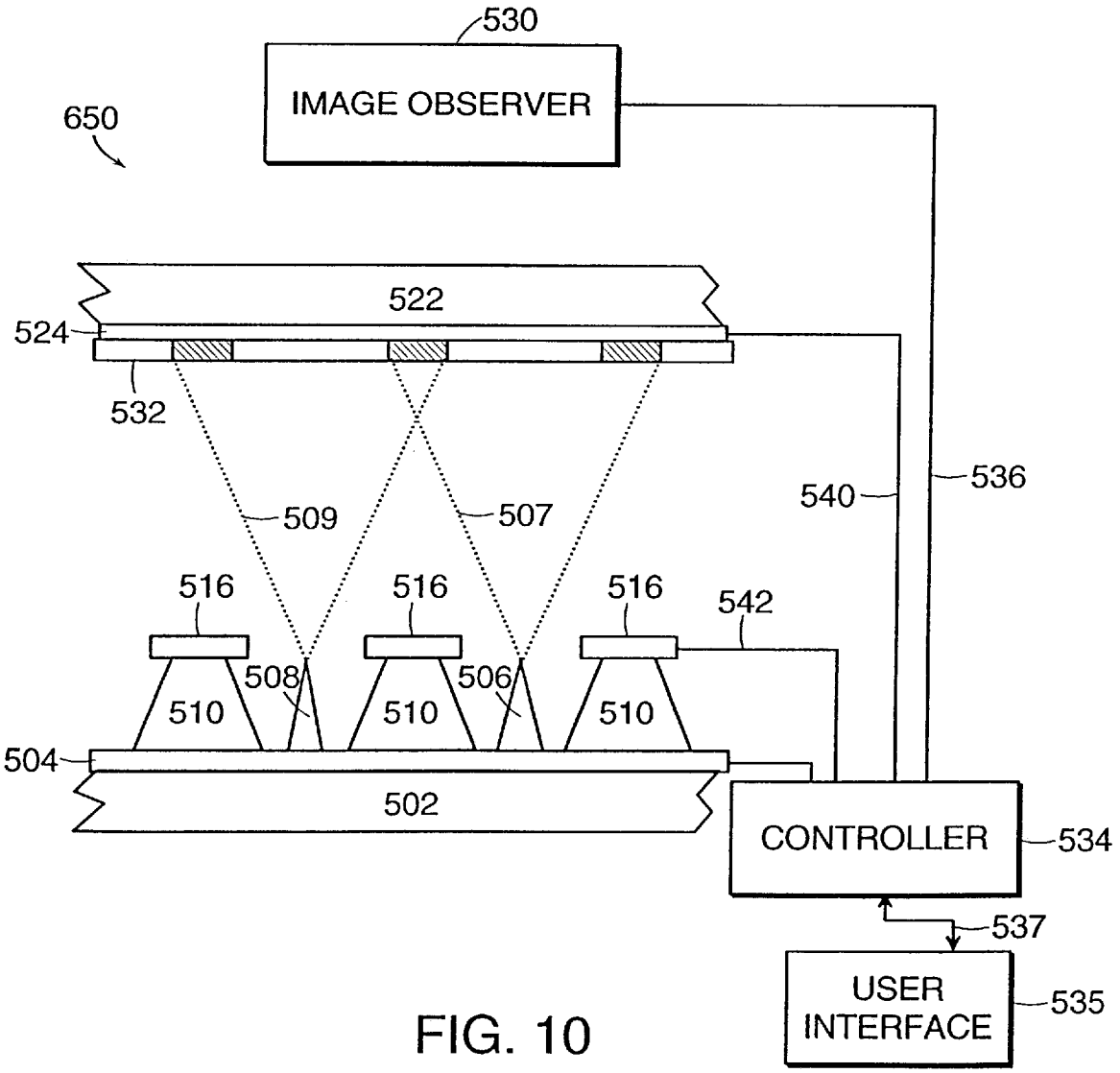
FIG. 10 shows the preferred embodiment of the present invention in which the ratio of the anode voltage to extraction structure voltage is small which adjusts the spot of the electron emission stream to be larger for a blended pixel edge definition.

Referring to FIGS. 9 and 10, on-line, active adjustment of the diameter of the electron emission stream will be described which will result in the viewer controlling the screen display effect ranging from very sharp with the chicken-wire effect present to a soft, blended effect with no chicken-wire effect present. In describing the operation of the present invention, reference will be made to FIGS. 6A and 6B which show a sharply defined and blended image, respectively.

Figure 1:
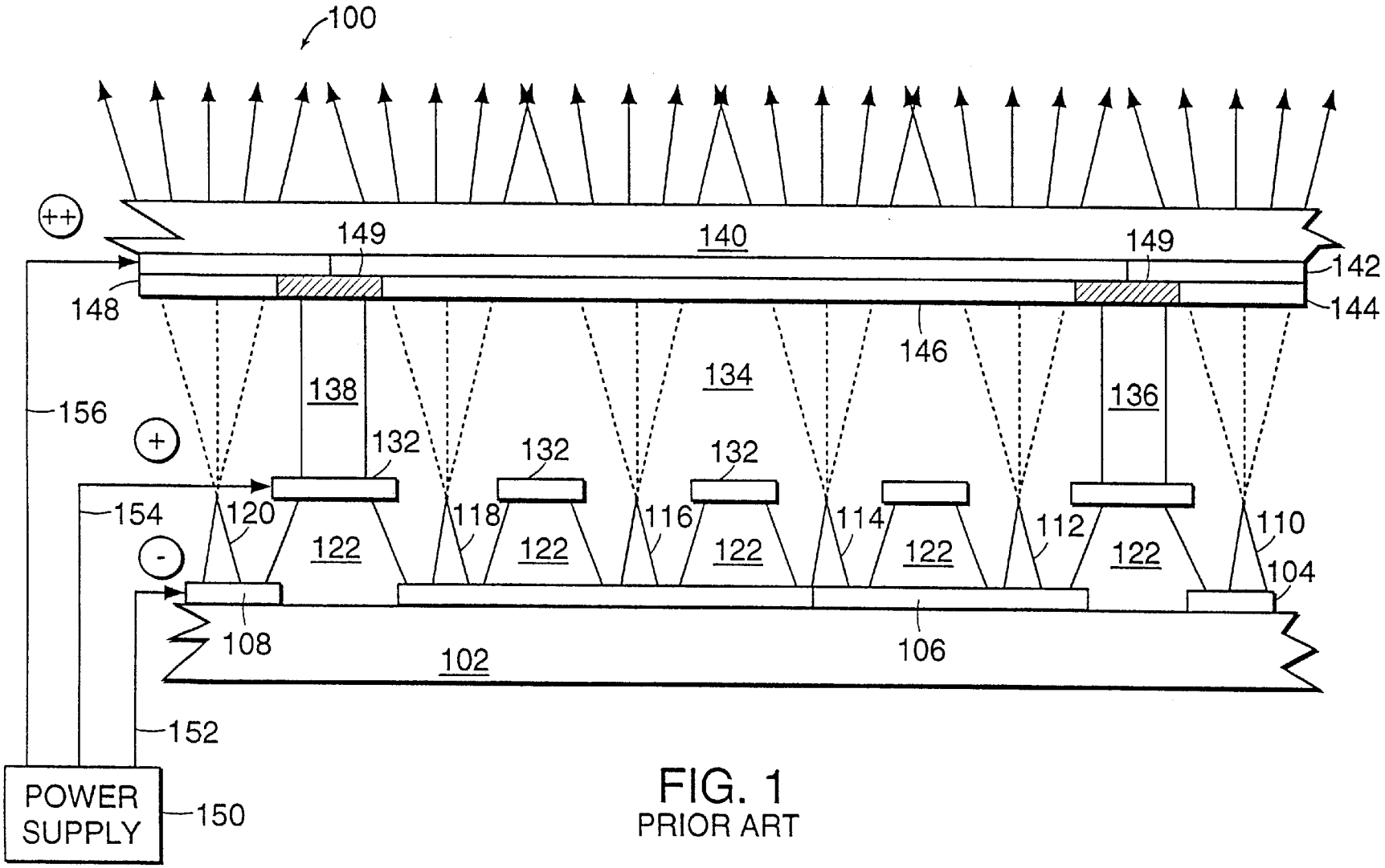
FIG. 1 PRIOR ART
FIG. 1 shows a partial cross-section of a prior art FED.
Figure 2:
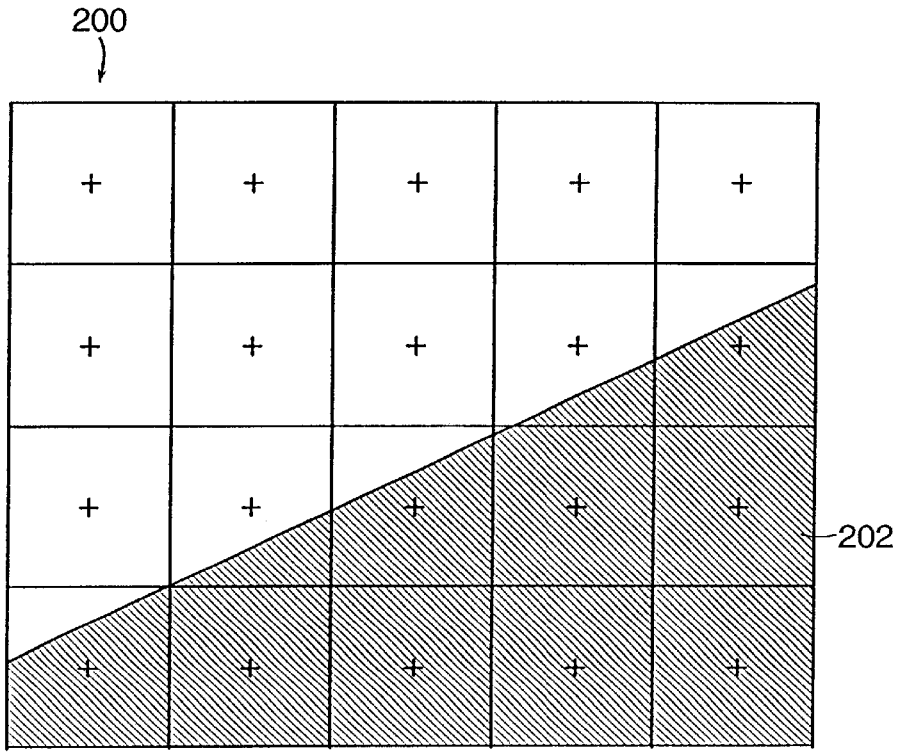
FIG. 2 shows a polygon that crosses a series of pixels of a screen display.
Figure 3:
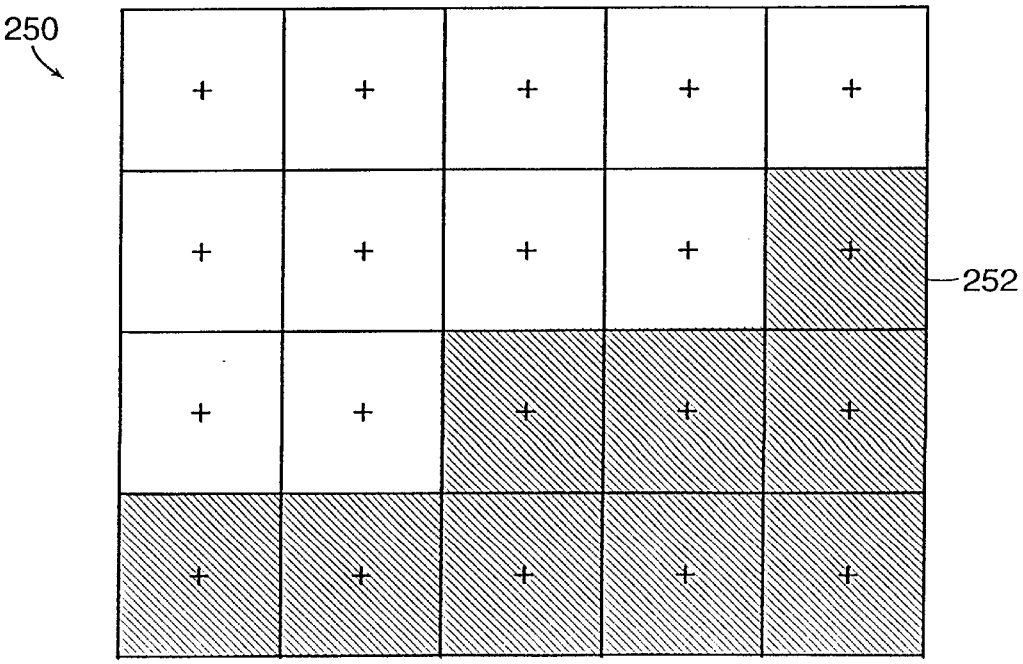
FIG. 3 shows the digitized representation of the polygon in FIG. 3 when the center method is used to control the color of the pixels.
Figure 4:
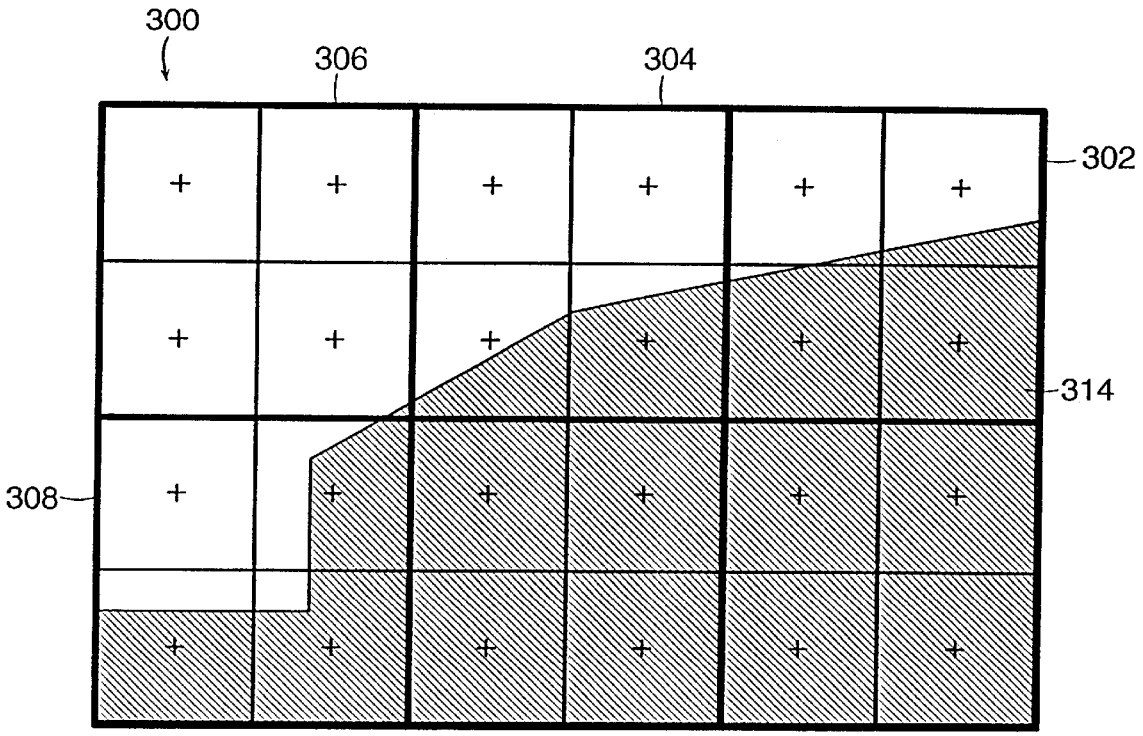
FIG. 4 show a series of pixels of a screen display that have been further divided into sub-pixels and a polygon that crosses this series pixels.
Figure 5:
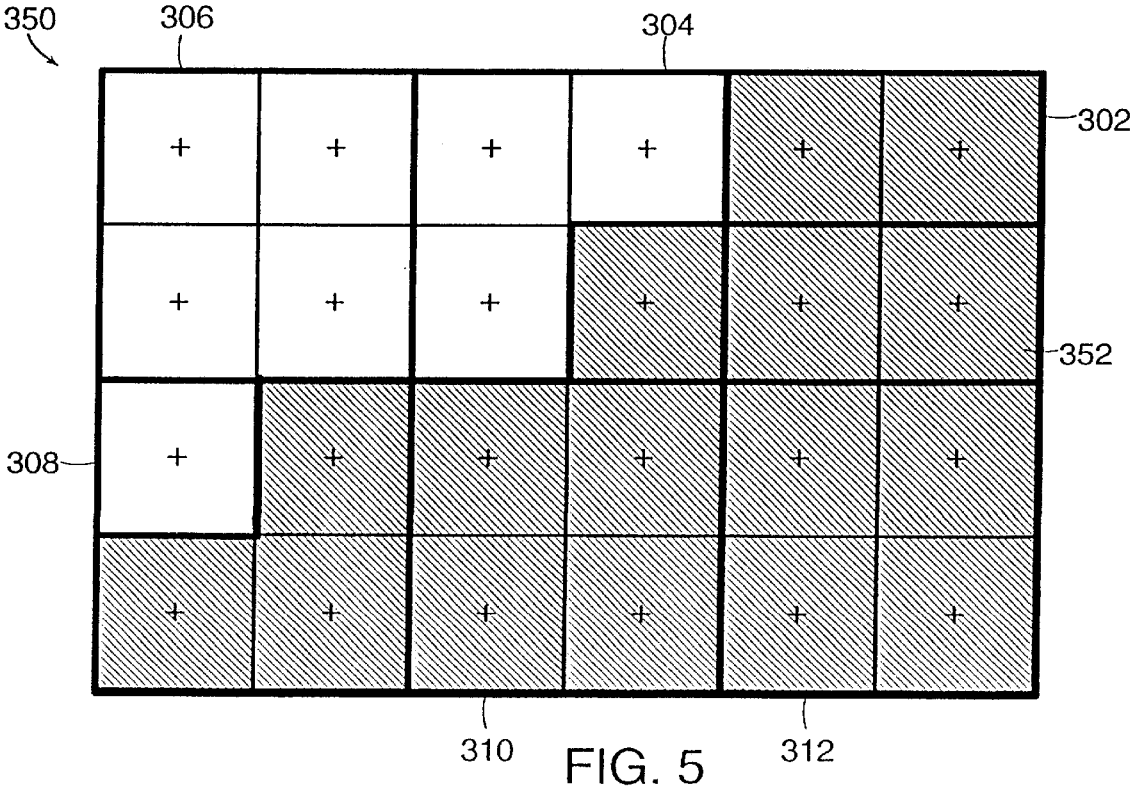
FIG. 5 shows the digitized representation of the polygon in FIG. 4 when the oversampling method is used to control the color of the pixels.
Figure 6A:
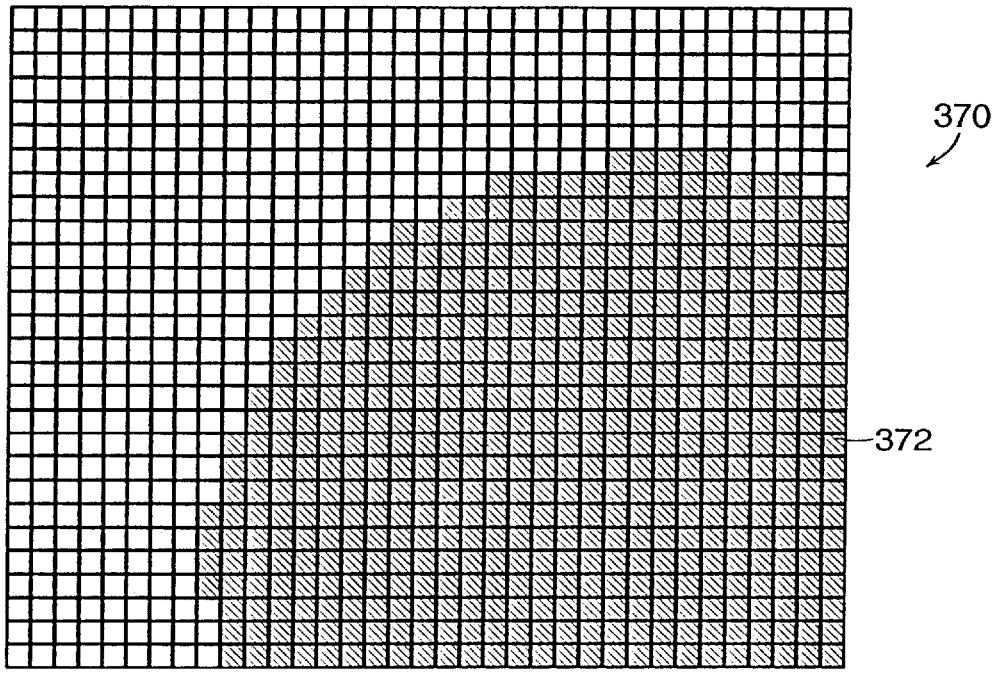
FIG. 6A shows a screen display of an FED in which the chicken-wire effect is present.

When the viewer desires a very sharply defined image, like 372 in FIG. 6A, which also may even result in the chicken-wire effect as is shown in FIG. 6A generally at 370, he or she will send commands to controller 534, via user interface 535, to increase the ratio of the anode voltage to the extraction structure voltage. This will cause either variable resistor 558 to increase the anode voltage with regard to the extraction structure voltage, or cause variable resistor 564 to decrease the extraction structure voltage with respect to the anode voltage, or cause variable resistor 558 to increase the anode voltage and variable resistor 564 to decrease the extraction structure voltage to provide the greatest operable ratio of the anode voltage to the extraction structure voltage.

As the ratio of the anode voltage to the extraction structure voltage increases, the lateral component of the electron emission stream trajectory, which is controlled by the extraction structure voltage, will have less of an affect and the vertical component of the electron emission stream trajectory, which is controlled by the anode voltage, will have a greater affect. The result is as shown in FIG. 9, the diameter of the electron emission stream is smaller as it impinges on the pixel. When this is the case, even though the image is sharper, the black matrix, which separates the pixels, can create the chicken-wire effect in the screen display image that is presented. However, because the present invention provides for on-line, active adjustment of the anode and extraction structure voltages, the ratio of these voltages can be adjusted to keep the sharp image but eliminate the chicken-wire effect.

It is understood that in carrying out the operation of the FED according to the present invention as just described, the viewer may choose to use image observer 538, the naked eye, or the naked eye assisted by a magnification device to evaluate the condition of the images on the screen display and determine when the desired screen display effect is achieved.

Figure 6B:
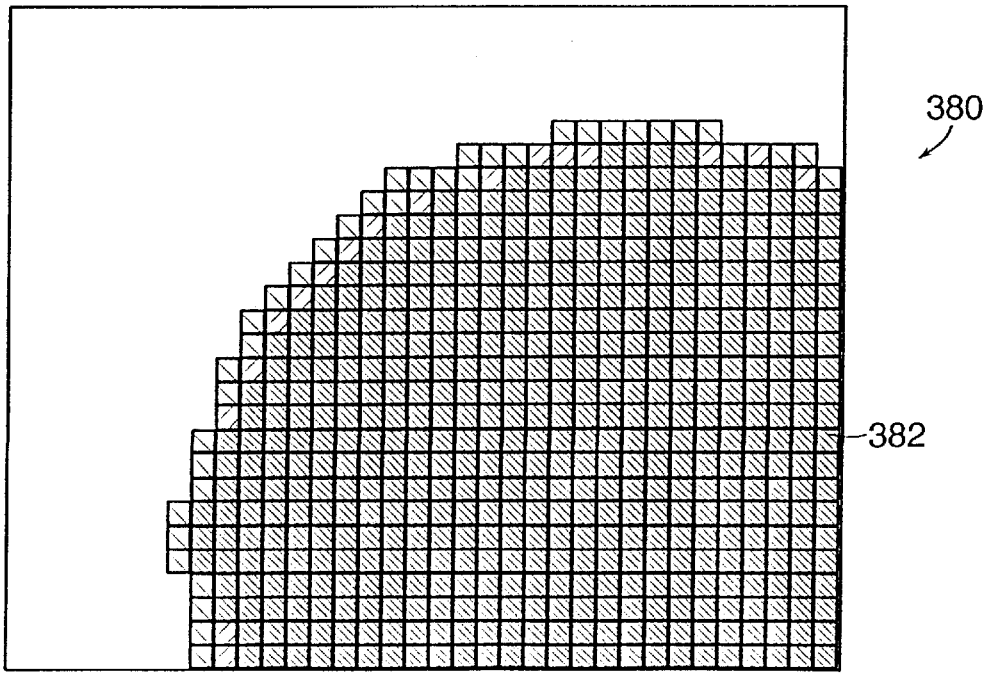
FIG. 6B shows a screen display of an FED in which the chicken-wire effect is eliminated and there is a blending (or softening) of the image boundaries.

Referring now to FIGS. 6B and 10, when the viewer desires a softer image, like image 382 in FIG. 6B, which eliminates the chicken-wire effect and blends the edges of images (as is shown in FIG. 6B generally at 380), he or she will sent commands to controller 534, via user interface 535, to decrease the ratio of the anode voltage to the extraction structure voltage. This will cause either variable resistor 558 to decrease the anode voltage with regard to the extraction structure voltage, or cause variable resistor 564 to increase the extraction structure voltage with respect to the anode voltage, or cause variable resistor 558 to decrease the anode voltage and variable resistor 564 to increase the extraction structure voltage to provide the smallest operable ratio of the anode voltage to the extraction structure voltage.

As the ratio of the anode voltage to the extraction structure voltage decreases, the lateral component of the electron emission stream trajectory, which is controlled by the extraction structure voltage, will have more of an effect and the vertical component of the electron emission stream trajectory, which is controlled by the anode voltage, will have less of an affect. The result is as shown in FIG. 10, the diameter of the electron emission stream as it impinges on the pixel is larger. When this happens, there is a blending of the light eliminating from adjacent pixels and an elimination from view of the black matrix, which separates the pixels. Here again, because the present invention provides for active adjustment of the anode and extraction structure voltages, the ratio of these voltages can be adjusted to achieve the desired blending or softening of the images.

As discussed previously, it is understood that in carrying out the operation of the FED according to the present invention as just described, the viewer may choose to use image observer 538, the naked eye, or the naked eye assisted by a magnification device to evaluate the condition of the images on the screen display and determine when the desired screen display effect is achieved.

The terms and expressions which are used herein are used as terms of expression and not of limitation. There is no intention in the use of such terms and expressions of excluding the equivalents of the features shown and described, or portions thereof, it being recognized that various modifications are possible in the scope of the present invention.

What is claimed is:

1. A field emission device system, comprising:

a substrate;

a first electrically conductive structure disposed over the substrate;

electron emitting structures disposed above, and extending upward relative to, the first electrically conductive structure;

an insulating layer disposed above the first electrically conductive structure, with the insulating layer having an opening therein for receiving and surrounding each electron emitting structure;

a second electrically conductive structure disposed above the insulating layer, with the second electrically conductive layer having an opening aligned with each opening in the insulating layer and an opening in the second electrically conductive structure surrounding an electron emitting structure;

a light transmissive faceplate disposed above the second electrically conductive structure;

a third electrically conductive structure disposed below the faceplate toward the second electrically conductive structure;

phosphor material disposed below the third electrically conductive structure toward the second electrically conductive structure with the phosphor material being capable of emitting light when excited by electrons;

a controller that is electrically connected to the first, second, and third conductive structures for controllably providing a first voltage to the first electrically conductive structure, an adjustable second voltage to the second electrically conductive structure, and an adjustable third voltage to the third electrically conductive structure, with the first voltage being at a predetermined level, the second and third voltages being more positive than the first voltage, and the second and third voltages being separately adjustable so that an adjustment causing a voltage increase in one of the second and third voltages can take effect concurrently with another adjustment causing a voltage decrease in the other of the second and third voltages, the second and third voltages being adjustable in respective ranges to effect an electron emission stream from each electron emitting structure that is controllable with regard to an area of phosphor material upon which a particular electron emission stream impinges.

2. The system as recited in claim 1, wherein the first electrically conductive structure comprises an emitter electrode.

3. The system as recited in claim 2, wherein the emitter electrode further comprises a plurality of electrically connected parallel disposed strips.

4. The system as recited in claim 2, wherein the second electrically conductive structure comprises an extraction structure.

5. The system as recited in claim 4, wherein the extraction structure further comprises a plurality of electrically connected parallel disposed strips.

6. The system as recited in claim 4, wherein the extraction structure further comprises a continuous layer of electrically conductive material.

7. The system as recited in claim 4, wherein the third electrically conductive structure comprises an anode.

8. The system as recited in claim 7, wherein the first voltage includes a ground voltage.

9. The system as recited in claim 8, wherein the adjustable second voltage is a positive voltage that is adjustable in a range that will cause an electron emission stream to be emitted from each electron emitting structure.

10. The system as recited in claim 9, wherein the adjustable third voltage is a positive voltage that is greater than the adjustable second voltage, with the adjustable third voltage being adjustable in a range that will cause the electron emission stream emitted from each electron emitting structure to be attracted to the anode.

11. The system as recited in claim 10, wherein the system further includes a user interface that is connected to the controller for providing signals to the controller for adjusting the adjustable second and third voltages.

12. The system as recited in claim 11, wherein the system further includes a faceplate monitor that is connected to the controller for providing feedback to the controller regarding a current visual representation of images on the faceplate.

13. A field emission device system, comprising:

a substrate;

a first electrically conductive structure disposed over the substrate;

electron emitting structures disposed above, and extending upward relative to, the first electrically conductive structure;

an insulating layer disposed above the first electrically conductive structure, with the insulating layer having an opening therein for receiving and surrounding each electron emitting structure;

a second electrically conductive structure disposed above the insulating layer, with the second electrically conductive layer having an opening aligned with each opening in the insulating layer and an opening in the second electrically conductive structure surrounding an electron emitting structure;

a light transmissive faceplate disposed above the second conductive structure;

a third electrically conductive structure disposed below the faceplate toward the second electrically conductive structure;

phosphor material disposed below the third electrically conductive structure toward the second electrically conductive structure with the phosphor material being capable of emitting light when excited by electrons;

a matrix structure disposed below the third conductive structure toward the second conductive structure;

a controller that is electrically connected to the first, second, and third conductive structures for controllably providing a first voltage to the first conductive structure, an adjustable second voltage to the second conductive structure, and an adjustable third voltage to the third conductive structure, with the first voltage being at a predetermined level, the second and third voltages being more positive than the first voltage, and the second and third voltages being separately adjustable so that an adjustment causing a voltage increase in one of the second and third voltages can take effect concurrently with another adjustment causing a voltage decrease in the other of the second and third voltages, the second and third voltages being adjustable in respective ranges to effect an electron emission stream from each electron emitting structure that is controllable with regard to an area of phosphor material upon which a particular electron emission stream impinges; and a user interface that is connected to the controller for provide signals to the controller for separately adjusting the adjustable second and third voltages so that an adjustment causing a voltage change in one of the second and third voltages can be made without causing a corresponding voltage change in the other of the second and third voltages.

14. The system as recited in claim 13, wherein the system further includes a faceplate monitor that is connected to the controller for providing feedback to the controller regarding a current visual representation of images on the faceplate in response to adjustments made to the electron emission streams emitted by the electron emitter structures with respect to the area of phosphor material upon which particular electron emission stream impinges.

15. The system as recited in claim 14, wherein the first electrically conductive structure comprises an emitter electrode.

16. The system as recited in claim 15, wherein the emitter electrode further comprises a plurality of electrically connected parallel disposed strips.

17. The system as recited in claim 15, wherein the second electrically conductive structure comprises an extraction structure.

18. The system as recited in claim 17, wherein the extraction structure further comprises a plurality of electrically connected parallel disposed strips.

19. The system as recited in claim 17, wherein the extraction structure further comprises a continuous layer of electrically conductive material.

20. The system as recited in claim 17, wherein the third electrically conductive structure comprises an anode.

21. The system as recited in claim 20, wherein the first voltage includes a ground voltage.

22. The system as recited in claim 21, wherein the adjustable second voltage is a positive voltage that is adjustable in a range that will cause an electron emission stream to be emitted from each electron emitting structure.

23. The system as recited in claim 22, wherein the adjustable third voltage is a positive voltage that is greater than the adjustable second voltage, with the adjustable third voltage being adjustable is a range that will cause the electron emission stream emitted from each electron emitting structure to be attracted to the anode.

24. A method for on-line adjustment of image definition at a faceplate of a field emission device system, with the field emission display system including a first electrically conductive structure, electron emitting structures disposed above, and extending upward relative to, the first electrically conductive structure, a second electrically conductive structure disposed above the first electrically conductive structure, a third conductive structure disposed above the second electrically conductive structure, phosphor material disposed below the third electrically conductive structure toward the second electrically conductive structure, and a controller that is electrically connected to the first, second, and third electrically conductive structures for controllably providing a first voltage to the first conductive structure, an adjustable second voltage to the second electrically conductive structure, and an adjustable third voltage to the third electrically conductive structure, with the first voltage being at a predetermined level, and the second and third voltages being separately adjustable so that an adjustment causing a voltage increase in one of the second and third voltages can take effect concurrently with another adjustment causing a voltage decrease in the other of the second and third voltages, the second and third voltages being adjustable in respective ranges to effect an electron emission stream from each electron emitting structure that is controllable with regard to an area of phosphor material upon which a particular electron emission stream impinges, comprising:

(a) viewing a current visual representation of an image on a faceplate disposed above the second electrically conductive structure; and (b) by at least one adjustment to at least one of said second and third voltages, each said adjustment to one of said second and third voltages being separate from each said adjustment to the other of said second and third voltages so that an adjustment causing a voltage increase in one of the second and third voltages can take effect concurrently with another adjustment causing a voltage decrease in the other of the second and third voltages, adjusting a ratio of the adjustable third voltage to the adjustable second voltage to cause the electron emission streams emitted by the electron emitter structures to respectively impinge upon a lesser area of a phosphor than before the adjustment to the ratio was made.

25. A method for on-line adjustment of image definition at a faceplate of a field emission device system, with the field emission display system including, a first electrically conductive structure, electron emitting structures disposed above, and extending upward relative to, the first electrically conductive structure, a second electrically conductive structure disposed above the second electrically conductive structure, a third conductive structure disposed above the second electrically conductive structure, phosphor material disposed below the third electrically conductive structure toward the second electrically conductive structure, and a controller that is electrically connected to the first, second, and third electrically conductive structures for controllably providing a first voltage to the first conductive structure, an adjustable second voltage to the second electrically conductive structure, and an adjustable third voltage to the third electrically conductive structure, with the first voltage being at a predetermined level, and the second and third voltages being separately adjustable so that an adjustment causing a voltage increase in one of the second and third voltages can take effect concurrently with another adjustment causing a voltage decrease in the other of the second and third voltages, the second and third voltages being adjustable in respective ranges to effect an electron emission stream from each electron emitting structure that is controllable with regard to an area of phosphor material upon which a particular electron emission stream impinges, comprising:

(a) viewing a current visual representation of an image on a faceplate disposed above the second electrically conductive structure; and (b) by at least one adjustment to at least one of said second and third voltages, each said adjustment to one of said second and third voltages being separate from each said adjustment to the other of said second and third voltages so that an adjustment causing a voltage increase in one of the second and third voltages can take effect concurrently with another adjustment causing a voltage decrease in the other of the second and third voltages, adjusting a ratio of the adjustable third voltage to the adjustable second voltage to cause the electron emission streams emitted by the electron emitter structures to respectively impinge upon a greater area of a phosphor than before the adjustment to the ratio was made.

26. A field emission display, comprising:

a substrate assembly having a plurality of emitter tips thereabove;

a conductive grid assembly disposed in spaced relation to said substrate, said grid including a plurality of conductive elements;

a display screen disposed in spaced relation to said grid assembly and on the opposite side of said grid assembly from said substrate assembly, said screen including a plurality of conductive elements; and a control assembly configured to couple a first voltage to said conductive elements of said grid assembly and to couple a second voltage to said conductive elements of said screen assembly, said control assembly operable to vary the magnitude of said first and second voltages, said control assembly operable to vary the magnitude of one of said first and second voltages separately from varying the other of said first and second voltages so that an adjustment causing a voltage increase in one of the first and second voltages can take effect concurrently with another adjustment causing a voltage decrease in the other of the first and second voltages.

27. A field emission display, comprising:

a substrate assembly having a plurality of emitter tips thereabove, said emitter tips operable to emit electrons at least partially in response to a first voltage applied thereto;

a conductive grid assembly disposed in spaced relation to said substrate, said conductive grid assembly comprising a plurality of conductive elements;

a display screen disposed in spaced relation to said grid assembly, said display screen comprising a plurality of conductive elements;

a first variable voltage supply coupled to said conductive elements of said grid assembly; and a second variable voltage supply coupled to said conductive elements of said display screen, said first and second variable voltage supplies being separately variable so that an adjustment causing a voltage increase in one of the first and second variable voltage supplies can take effect concurrently with another adjustment causing a voltage decrease in the other of the first and second variable voltage supplies.

28. A method of adjusting the image output of a field emission display having a plurality of emitter tips, an extraction grid, and a display screen, comprising:

applying a first voltage to a first plurality of said emitter tips;

applying a second voltage to at least a portion of said extraction grid;

applying a third voltage to at least a portion of said display screen, said second and third voltages being separately variable so that an adjustment causing a voltage increase in one of the second and third voltages can take effect concurrently with another adjustment causing a voltage decrease in the other of the second and third voltages; and varying at least one of said second and third voltages sufficiently to alter the image rendered by said display.

29. A method of altering the image rendered by a field emission display including a plurality of emitter tips, an extraction grid and conductive elements in a display screen, comprising:

applying a first voltage to at least one emitter tip of said plurality of emitter tips;

applying a second voltage to said extraction grid at a location proximate said emitter tip to which said first voltage is applied;

applying a third voltage to a portion of said display screen, said second and third voltages being separately variable so that an adjustment causing a voltage increase in one of the second and third voltages can take effect concurrently with another adjustment causing a voltage decrease in the other of the second and third voltages, said first, second and third voltages cooperating with said structure to generate an electron emission stream impinging upon a first area of said display screen; and changing the area of said display screen impinged by said electron emission stream.

30. The method of claim 29, wherein changing the area impinged by said electron beam emission includes varying at least one of said second voltage and said third voltage.

* * * * *